United States Patent [19]

Rozek

[11] Patent Number: 4,575,881

[45] Date of Patent: Mar. 18, 1986

[54] PERPENDICULAR TOILET TRIP LEVER ASSEMBLY

[75] Inventor: Roy J. Rozek, Plymouth, Wis.

[73] Assignee: Kohler Co., Kohler, Wis.

[21] Appl. No.: 687,457

[22] Filed: Dec. 28, 1984

[51] Int. Cl.[4] ..... E03D 5/00

[52] U.S. Cl. ..... 4/405; 403/349

[58] Field of Search ..... 4/405, 411, 324, 413, 4/414; 403/349; 411/516

[56] References Cited

U.S. PATENT DOCUMENTS

| | | | |
|---|---|---|---|
| 465,839 | 12/1891 | Dearborn | 4/405 |
| 925,550 | 6/1909 | Young et al. . | |
| 945,424 | 1/1910 | Tilden . | |
| 1,103,141 | 7/1914 | Heap | 4/414 |
| 1,250,026 | 12/1917 | Saal . | |
| 2,609,546 | 9/1952 | Gulick . | |
| 2,627,607 | 2/1953 | Crampton . | |
| 2,963,710 | 12/1960 | Carter . | |
| 3,419,912 | 1/1969 | Kertell | 4/324 |
| 3,426,365 | 2/1969 | Ament et al. . | |
| 3,518,703 | 7/1970 | Haldopoulos et al. . | |
| 3,775,778 | 12/1973 | Lee . | |
| 3,851,601 | 12/1974 | Davis | 403/349 |
| 3,922,731 | 12/1975 | Korol | 4/405 |
| 4,141,092 | 2/1979 | Jones | 4/324 |
| 4,240,167 | 12/1980 | Gilliland | 4/324 |
| 4,240,168 | 12/1980 | Duke | 4/326 |
| 4,392,279 | 7/1983 | Schwager | 403/349 |
| 4,487,469 | 12/1984 | Björk | 403/349 |

*Primary Examiner*—Stephen Marcus
*Assistant Examiner*—L. J. Peters
*Attorney, Agent, or Firm*—Quarles & Brady

[57] ABSTRACT

A toilet trip lever assembly which is mountable in a hole in a sidewall of a toilet tank is disclosed. A bearing extends through the hole and has an axial bore therethrough. Retaining means is affixed to the bearing inside the toilet tank to limit the outward movement of the bearing relative to the hole. A stem is journaled within the bearing and has an end which extends into the toilet tank and includes an offset surface. A handle is connected to the outer end of the stem and is operable by a user to rotate the stem. A boom is mounted to pivot in a plane perpendicular to the tank side wall about a pivot post which extends radially from the retaining means. An arm extends from the boom onto the offset surface and an end of the boom is connected to a flush valve. Rotation of the stem and offset surface pivots the boom to flush the toilet.

9 Claims, 25 Drawing Figures

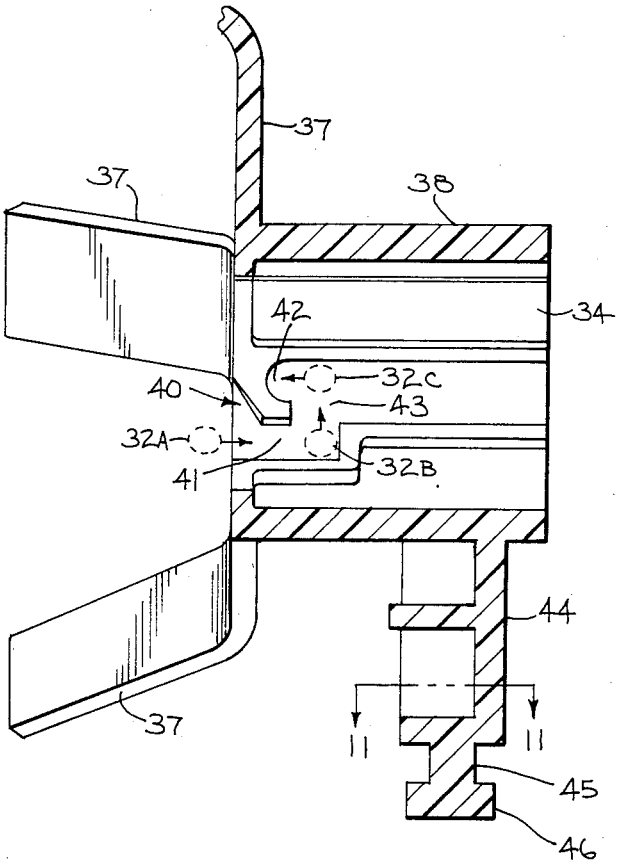
FIG. 10
FIG. 11
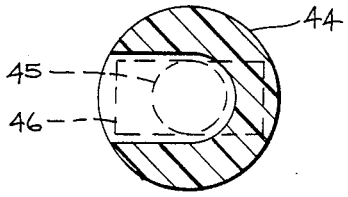
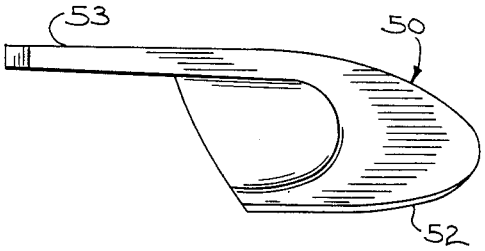
FIG. 12
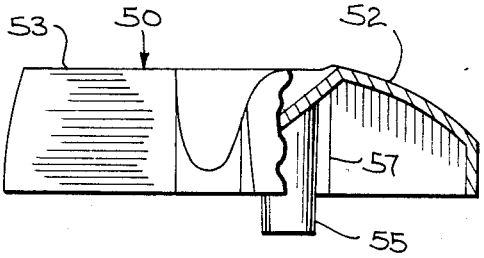
FIG. 13
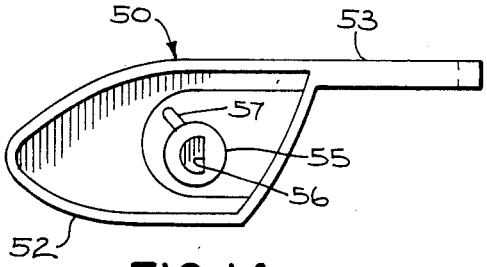
FIG. 14
FIG. 15
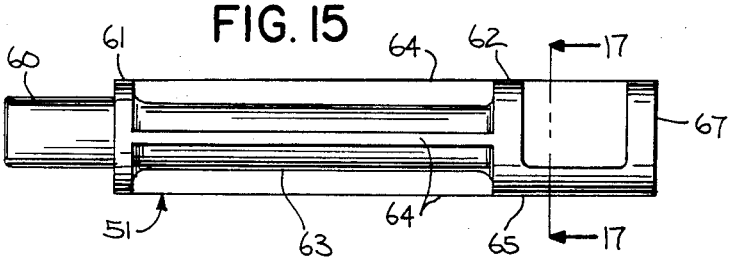
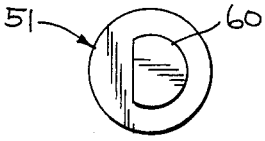
FIG. 16
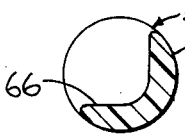
FIG. 17

20
21
23
51
65
66
68
69
70
71
72

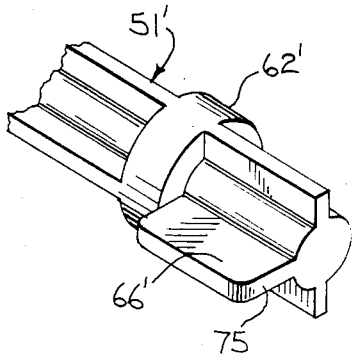
FIG. 25
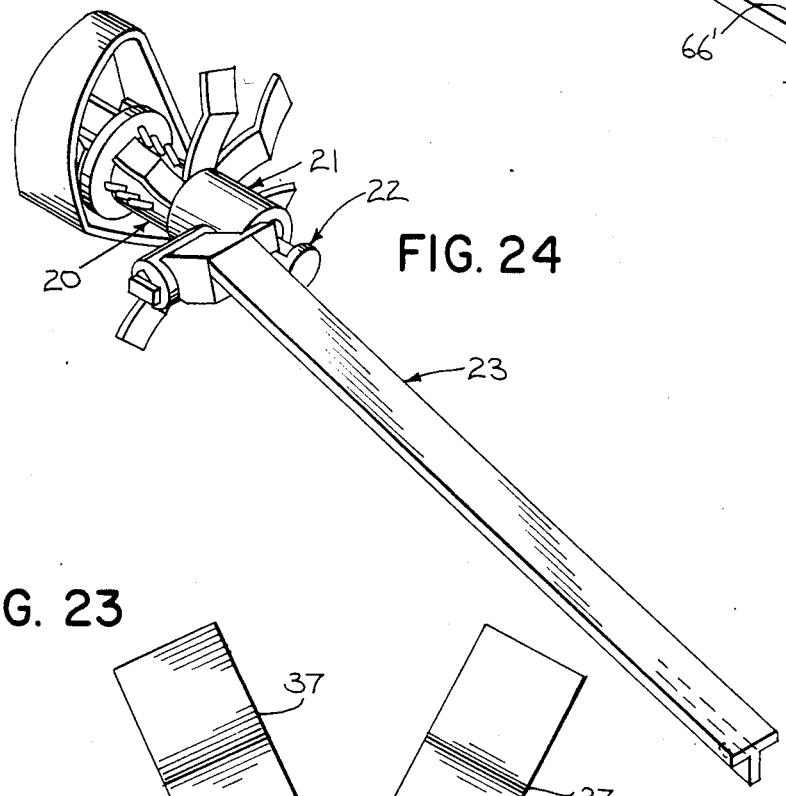
FIG. 24
FIG. 23
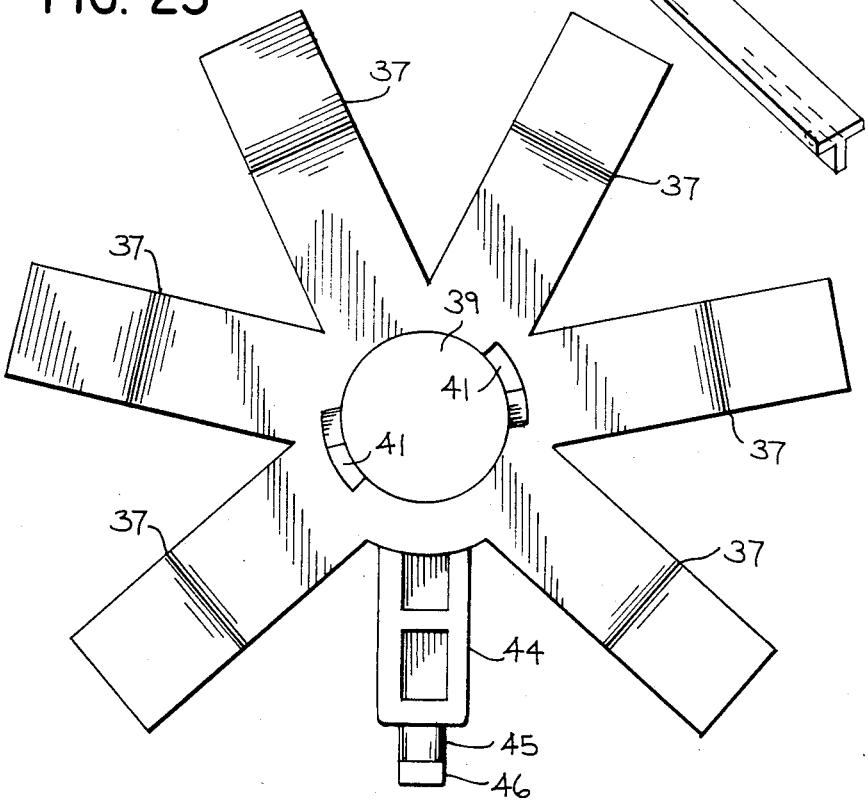

PERPENDICULAR TOILET TRIP LEVER ASSEMBLY

BACKGROUND OF THE INVENTION

1. Field of the Invention

This invention relates to toilet trip lever assemblies and in particular to a toilet trip lever assembly which is mountable to the side wall of a toilet tank.

2. Description of the Prior Art

Toilet trip lever assemblies are well known. They usually comprise a stem which is rotatably mounted in the front wall of a toilet tank, a handle which extends radially from the stem outside of the toilet tank and a trip arm which extends radially from the stem inside the toilet tank. The trip arm is connected to the toilet tank outlet valve. When a user rotates the handle, the trip arm is rotated about the same axis as the handle in a plane parallel to the tank front wall and opens the outlet valve.

Space limitations and ornamental considerations in modern toilet tanks have made a toilet trip apparatus which is mountable in a side (as opposed to front) tank wall desirable. For a toilet trip apparatus of this type, it is desirable that rotation of the handle produce a rotation of the trip arm in a plane which is perpendicular to the plane of the side wall. Of course, this requirement has been attended by a mechanism which is much more complex than the front wall mounted toilet trip mechanisms.

Kertell U.S. Pat. No. 3,419,912 issued Jan. 7, 1969 discloses one such prior art side wall mounted toilet trip lever assembly. However, the parts of the Kertell mechanism are metal and are relatively difficult to manufacture. These parts are assembled with numerous mechanical fasteners such as nuts and rivets so that the mechanism must be assembled in one or more subassembly operations. Only then can the mechanism be mounted to the toilet tank. Further, devices like Kertell are very time consuming to assemble and relatively expensive to produce. Therefore, a need exists for a "perpendicular" type toilet trip lever assembly which is easy and inexpensive to manufacture, assemble and mount.

SUMMARY OF THE INVENTION

The invention provides a toilet trip lever assembly which is mountable in a hole in a side wall of a toilet tank. A bearing is extendable through the hole and has an axial bore therethrough. Retaining means for limiting the outward movement of the bearing relative to the hole are suitable to be removably affixed to the bearing inside the toilet tank. A stem is suitable to be journaled within the bearing for rotation therein. The inner end of the stem is extendable into the tank and includes an offset surface. A handle is connected to the outer end of the stem and is operable by a user to rotate the stem. A pivot post is extendable radially from the retaining means and a boom is mountable to the retaining means to pivot about the pivot post axis in a plane perpendicular to the tank side wall. An arm is affixed to the boom and extends to the offset surface so that rotation of the stem and offset surface pivots the boom. This construction results in only a few parts which are easy and inexpensive to manufacture, assemble and mount.

In an especially preferred form, the portion of the stem adjacent to the inner end of the stem has an L-shaped cross section. The L-shaped cross section portion includes the offset surface and defines a recess. An abutment wall is integral with the stem inward of the recess and the boom arm is positionable in the recess. In addition to raising the boom, the arm abuts the abutment wall to limit movement of the stem outward of the bearing.

In another aspect, the retaining means includes a nut which can be affixed to the bearing by a bayonet-type connection. The nut has a resilient outer portion which can bear against the inside of the tank side wall to hold the bayonet-type connection in a locked position. The bayonet-type connection insures that the pivot post axis will always be in nearly the same angular position with respect to the bearing regardless of variations in the thickness of the tank side wall. The bayonet-type connection also provides a fast and easy way to mount the nut to the bearing.

In another aspect of the invention, the boom and the retaining means can be removably interconnected by a key and slot type connection. Upon rotation of the boom on the pivot post axis to a first set of positions, the boom and the retaining means are interlocked but permit rotation of the boom relative to the retaining means. Upon rotation of the boom on the pivot post axis to a disassembly position, the boom and the retaining means can be pulled apart by relative movement along the pivot post axis. Therefore, no fasteners are required to assemble the boom to the retaining means so that the assembly operation can be performed quickly and easily.

The present invention provides a savings in assembly time over existing perpendicular toilet trip lever assemblies. The resulting toilet trip lever assembly is easily and quickly assembled. Furthermore, the components of a toilet trip lever assembly of the invention are few and are suitable to be molded from plastic materials which affords an even greater savings in manufacturing costs.

It is therefore a principal object of the invention to provide a "perpendicular" type toilet trip lever assembly which is easily and inexpensively assembled.

It is another object of the invention to provide a "perpendicular" type toilet trip lever assembly which is inexpensive to manufacture.

It is another object of the invention to provide a "perpendicular" type toilet trip lever assembly which can be assembled without mechanical fasteners or tools.

It is another object of the invention to provide a "perpendicular" type toilet trip lever assembly which does not require subassembly operations prior to final assembly in a toilet tank.

The foregoing and other objects and advantages of the invention will appear in the following detailed description. In the description, reference is made to the accompanying drawings which show, by way of illustration and not limitation, a preferred embodiment of the invention.

DESCRIPTION OF THE DRAWINGS

FIG. 10 is a sectional view taken on the line 10—10 of FIG. 9;

FIG. 11 is a sectional view taken on the line 11—11 of FIG. 10;

FIG. 12 is a front plan view of a handle for the toilet trip lever assembly;

FIG. 13 is a bottom plan view with a portion broken away of the handle of FIG. 12;

FIG. 14 is a rear plan view of the handle of FIG. 12;

FIG. 15 is a side plan view of a stem for the toilet trip lever assembly;

FIG. 16 is a plan view of the outside end of the stem of FIG. 15;

FIG. 17 is a sectional view taken on the line 17—17 of FIG. 15;

FIG. 23 is a plan view of the outer end of the nut of FIG. 8;

FIG. 24 is a perspective view of the toilet trip lever similar to FIG. 2, but in the tripped position; and FIG. 25 is a perspective view of the inside end of a second embodiment of a stem for the toilet trip lever assembly.

DETAILED DESCRIPTION OF THE PREFERRED EMBODIMENTS

Figure 1:
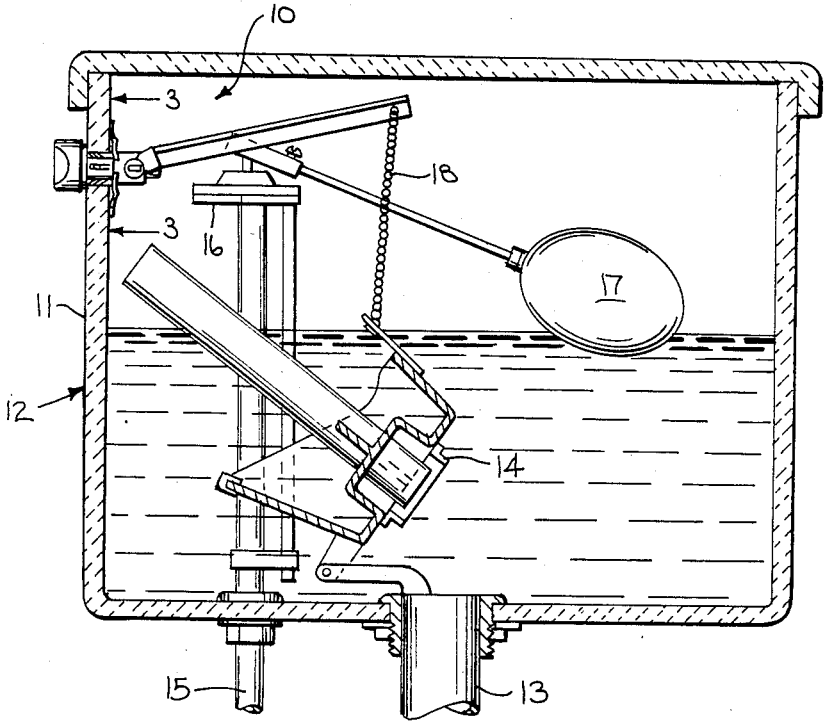
FIG. 1 is a front plan view, partially in section, of a toilet tank in which a toilet trip lever assembly of the present invention is mounted.

FIG. 1 shows a toilet trip lever assembly 10 of the present invention mounted in a side wall 11 of a toilet tank 12. An outlet pipe 13 leading to a toilet bowl (not shown) is normally sealed by an outlet valve 14. An inlet pipe 15 is connected to an inlet valve 16 which is controlled by a float 17 in a conventional manner. A chain 18 connects the trip assembly 10 to the outlet valve 14 to lift the outlet valve out of its seat in the outlet pipe 13 when the trip assembly is operated. Lifting the valve 14 off of its seat on the outlet pipe 13 causes the toilet to flush, as is well known.

Figure 2:
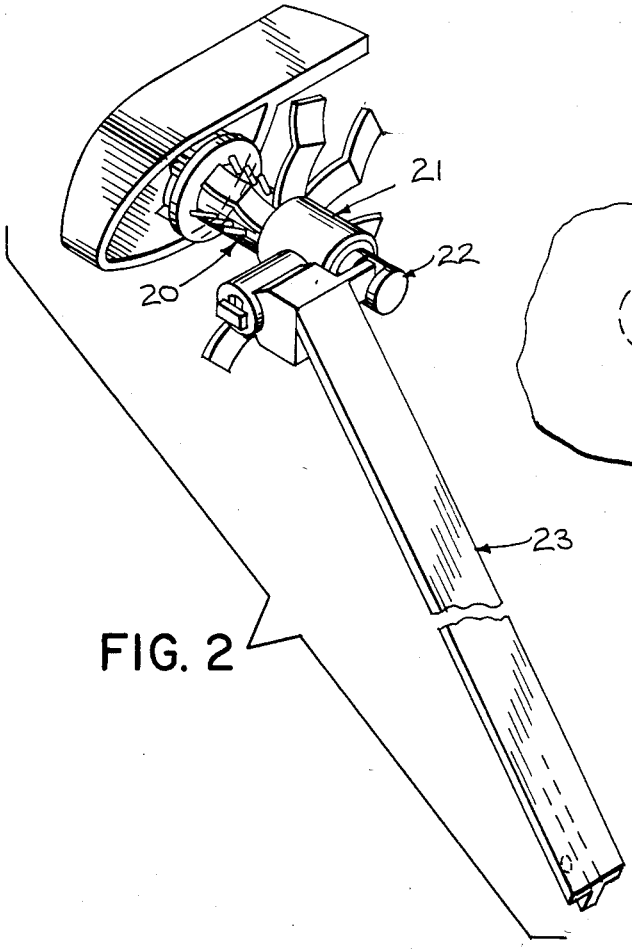
FIG. 2 is a perspective view of the toilet trip lever assembly of FIG. 1 in the untripped position.
Figure 3:
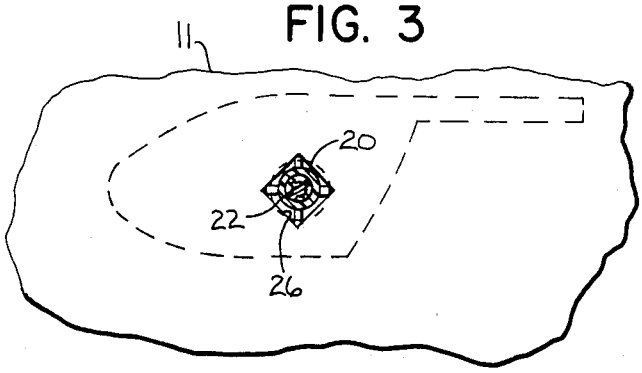
FIG. 3 is a view taken on the line 3—3 of FIG. 1.
Figure 4:
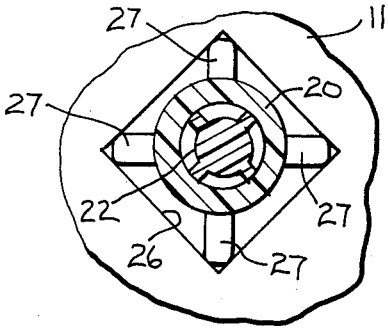
FIG. 4 is a detail view of a portion of the apparatus of FIG. 3.
Figure 5:
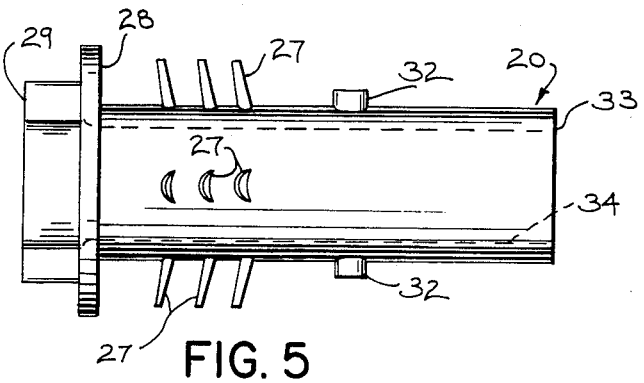
FIG. 5 is a side plan view of a bearing for the assembly of FIG. 1.
Figure 7:
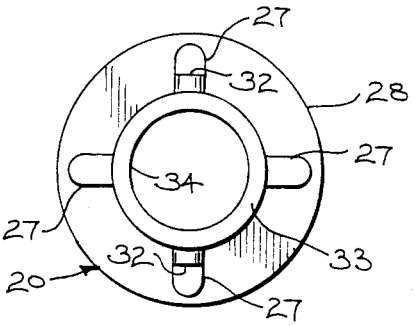
FIG. 7 is a plan view of the inside end of the bearing of FIG. 5.

FIG. 2 is a perspective view of the trip assembly 10 of the present invention in an untripped position. This is the normal position when the toilet is not being flushed. The assembly 10 comprises a bearing 20, a retaining means 21, a handle stem 22 and a boom 23. All of the components of the apparatus 10 are molded from suitable plastic materials with the exception of the handle portion of the handle stem 22, which can preferably be a metal. Hereinafter, the outer and inner directions are defined as being with reference to the tank side wall 11. (In FIG. 1, "outer" is towards outside the tank.)

The handle stem 22 is rotatable by the user within the bearing 20 to move the boom 23 from the untripped position of FIG. 2 where the outlet valve 14 is closed to the tripped position of FIGS. 1 and 24 where the outlet valve is open. Therefore, the boom 23 pivots in a plane which is perpendicular to the tank side wall 11.

Referring next to FIGS. 3–7, a noncircular opening 26 is formed in the side wall 11 of the toilet tank 12 to receive the bearing 20. Four rows of resilient fingers 27 which are integrally molded into the bearing 20 project radially from the bearing. The fingers 27 extend into the corners of the opening 26 and are deflected inwardly as the bearing is inserted into the opening 26 to restrain rotation of the bearing within the opening.

Figure 6:
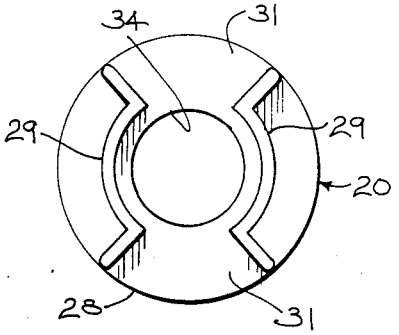
FIG. 6 is a plan view of the outside end of the bearing of FIG. 5.
Figure 8:
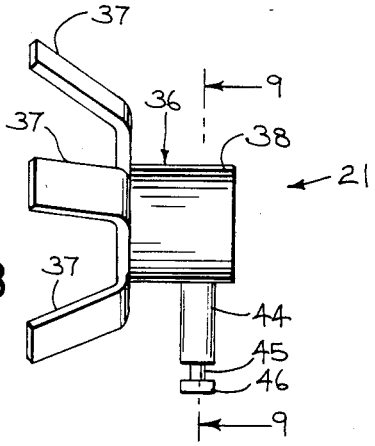
FIG. 8 is a side view of a nut for the toilet trip lever assembly.
Figure 9:
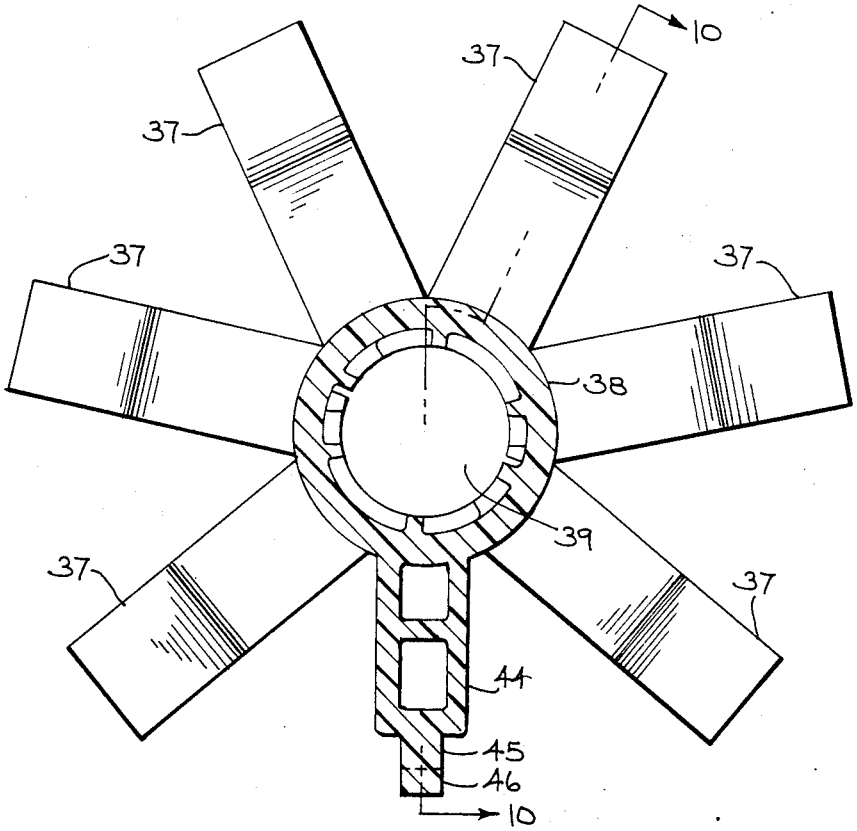
FIG. 9 is a sectional view taken on the line 9—9 of FIG. 8.

A radial flange 28 is formed on the outside end of the bearing 20. The flange 28 abuts the side wall 11 when the bushing is inserted into the opening 26. A pair of axial projections 29 are formed on the outer face of the flange 28 and define spaces 31 between their ends (FIG. 6).

A pair of elongated pins 32 are formed on the exterior surface of the bearing 20 (FIGS. 5, 7 and 10) a short distance inward from the fingers 27. The pins 32 project radially outwardly from the bearing and are disposed opposite from one another. An axial bore 34 extends all the way through the bearing 20 and the bearing 20 terminates in an end 33 a distance inward from the pins 32.

The bearing 20 is secured to the side wall 11 by the retaining means 21 which is illustrated in FIGS. 8–11 and 23. The retaining means 21 comprises a nut 36 which has six legs 37 extending radially from the outer end of a sleeve portion 38. The ends of the legs 37 are directed away from the sleeve portion 38 and the legs are resilient toward and away from the sleeve portion.

An axial bore 39 extends all the way through the sleeve portion 38. Referring particularly to FIG. 10, a pair of bayonet slots 40 are defined opposite from one another on the inside surface of the sleeve portion 38. Each slot 40 has a mouth channel 41 which is flared outwardly at the end of the sleeve portion 38, a seat 42 which is positioned a distance counter-clockwise as viewed in FIG. 9 from the mouth portion 41 and opens toward the inner end of the sleeve portion 38, and a connecting track 43 which adjoins the mouth portion 41 to the seat 42.

A pivot post 44 projects radially from the sleeve portion 38. The pivot post 44 is circular and may be hollow and rib-reinforced as shown for plastic molding considerations. The end of the pivot post defines a smaller radius portion 45 and a rectangular portion 46 at the end of the smaller radius portion 45. The width of the rectangular portion 46 is about equal to the diameter of the smaller radius portion 45 and the longitudinal axis of the rectangular portion is approximately parallel to the axis of the sleeve portion 38.

The nut 36 is assembled to the bearing 20 to hold the bearing in place as follows. With the bearing 20 in the opening 26 as previously described, the nut 36 is slid over the end 33 of the bearing 20 with the resilient legs 37 toward the side wall 11. The bore 39 of the nut 36 closely receives the bearing 20 as the nut 36 is slid toward the side wall 11 and begins to bias the sleeve portion 38 away from the side wall. When the inside end of the nut 36 abuts the connector pins 32, the nut 36 is rotated until the connector pins are aligned with the mouth channels 41 of the bayonet trackways 40 as shown in phantom in position 32A in FIG. 10. The sleeve portion 38 is then slid further toward the side wall 11 and the flared ends of the mouth channels 41 guide the connector pins into the mouth channels 41. When the sleeve portion 38 can be slid no further toward the side walls 11 because the connector pins 32 have reached the inside ends of the mouth channels 41 as shown in position 32B, the connector pins 32 are aligned with the connecting tracks 43. The nut 36 can then be rotated clockwise as viewed in FIG. 9 relative to the bearing 20 to align the connector pins 32 with the seats 42 of the bayonet trackways 40 as shown in position 32C. The nut 36 is then released and the legs 37 bias the sleeve portion 38 away from the side wall 11 so that the connector pins 32 enter the seats 42 of the bayonet trackways 40. In this position the pivot post 41 has a substantially horizontal axis.

The handle stem 22 includes a handle 50 and a stem 51. The handle 50 and stem 51 may be either integral or may be an assembly of two pieces. The preferred embodiment contemplates the handle stem 22 as an assembly of two pieces.

Referring to FIGS. 12–14, the handle 50 includes an escutcheon 52 and a lever 53. A projection 55 extends from the interior of the escutcheon 52 and defines a D-shaped receiving recess 56. A wall 57 extends outwardly a short distance from the side of the projection 55.

An end 60 of the stem 51 is D-shaped (FIGS. 15 and 16) and is sized to fit within the D-shaped recess 56 of the handle 50. Inward of the D-shaped end 60 are two circular cylindrical bearing surfaces 61 and 62 at the ends of a reduced diameter shaft 63 which is reinforced by ribs 64. The diameter of the surfaces 61 and 62 is slightly smaller than the diameter of the bore 34 of the bearing 20 so that the stem can rotate freely within the bearing 20. The bearing surface 62 is coterminus with a portion 65 which has a L-shaped cross-section as shown in FIG. 17. The portion 65 includes an offset surface 66 at its edge and is closed at its inward end by an abutment wall 67.

The stem 51 is assembled to the handle 50 to provide the handle stem. The D-shaped end 60 of the stem 51 is inserted into the D-shaped recess 56 and is closely received therein. The outer diameter of the projection 55 is approximately equal to the diameter of the surface 61 to form a substantially continuous bearing surface with the surface 61. A suitable adhesive or other fastening means can be used to secure the connection between the handle 50 and the stem 51. The mating D-shaped surfaces assure that the handle and the stem are not rotatable with respect to one another. However, some other connecting means would also serve this function or, as previously mentioned, the handle 50 and stem 51 could be made integral with one another.

When the stem 51 of the handle stem 22 is inserted into the bearing 20, the projection 55 enters the bore 34 and the wall 57 enters one of the spaces 31 between the projections 29 to limit the angular motion of the handle stem 22. The wall 54 abuts the flange 28 to stop the motion of the handle stem 22 into the bearing 20. In this position, the end of the projection 55 and the two bearing surfaces 61 and 62 are within the bearing 20 and the L-shaped portion 65 extends out the inside end 33 of the bearing 20. Also, the L-shaped portion 65 opens upwardly with the offset surface 66 toward the side of the bearing 20 with the pivot post 44 on it.

The boom 23 is shown in FIGS. 18–21. The end of the boom 23 has a transverse bore 68 which fits over the pivot post 44. One end of the bore 68 is partially closed as it defines an elongated opening 69 which is slightly wider and longer than the rectangular portion 46 on the end of the pivot post 44. The elongated opening 69 is aligned with the rectangular portion 46 when the lever arm is in a substantially vertical, disassembly position. In this position, the elongated opening 69 can be slid past the rectangular portion 46 into registration with the smaller radius portion 45 and the boom 23 can be rotated approximately 90° to its operating range of positions. In the operating range of the boom 23, the rectangular portion 46 is not aligned with the elongated opening 69 so that the boom 23 is locked on the pivot post 44 but is rotatable relative thereto. Note that the portion 46 and the opening 69 need not be rectangular but could be any noncircular shape to carry out this key and slot type connection.

Figures 18, 19, 20, 21, 22:
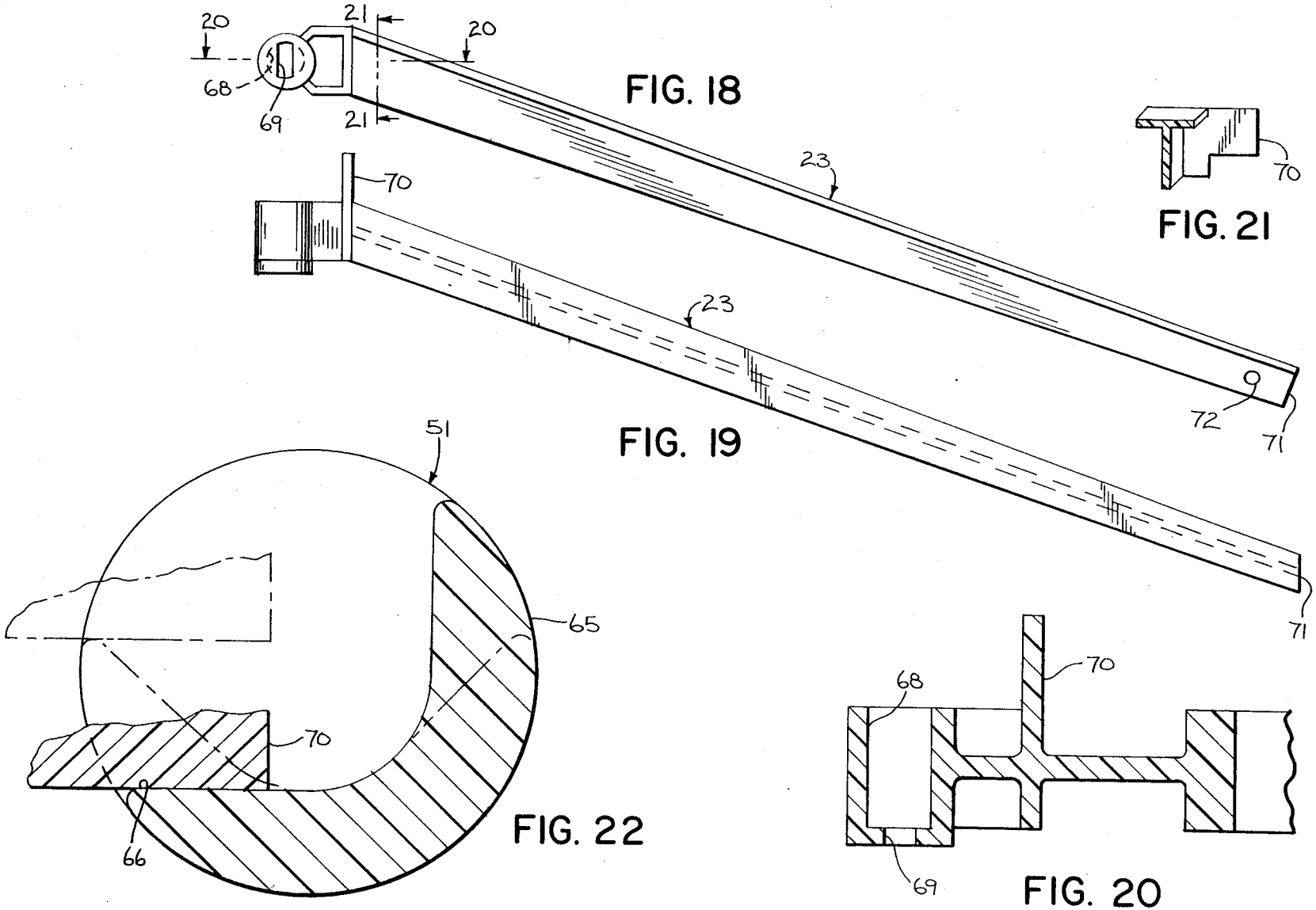
FIG. 18 is a side plan view of a boom for the toilet trip lever assembly.
FIG. 19 is a top plan view of the boom of FIG. 18.
FIG. 20 is a sectional view taken on the line 20—20 of FIG. 18.
FIG. 21 is a sectional view taken on the line 21—21 of FIG. 18.
FIG. 22 is a view similar to FIG. 17 but illustrating a portion of the boom arm and showing the up position in phantom.

The boom 23 also has a transverse arm 70 positioned a short distance inward from the bore 68. The arm 70 is positioned in the recess defined by the L-shaped portion 65 to support the boom in the down position as shown in FIGS. 2 and 22. With the arm 70 positioned in the recess, the abutment wall 67 limits the outward movement of the handle stem 22. The handle stem 22 is thereby retained for rotation within the bearing 20.

The boom 23 is pivoted upwardly about the axis of the pivot post 44 by rotating the handle 50. Rotating the handle 50 rotates the stem 51 and the offset surface 66 to raise the arm 70 as shown in phantom in FIG. 22 and in Fig. 24. The small rotational movement of the offset surface 66 is amplified at an end 71 of the boom opposite from the pivot post 44 since the arm 70 is close to the pivot post 44 relative to the distance that it is from the end 71. A hole 72 adjacent to the end 71 is suitable to be connected to the typical chain 18. Therefore, the rotary motion of the handle stem 22 is translated into pivotal motion in a plane which is perpendicular to the side wall 11, to lift the outlet valve 14 out of its valve seat to flush the toilet.

FIG. 25 shows an alternate embodiment of the stem 51 which is designated as 51'. The stem 51' is the same as the stem 51 except for the configuration of the portion of the stem adjacent to the inner end of the stem. The inner end portion of the stem 51' does not have an L-shaped cross-section as does the portion 65 of the stem 51, but nevertheless defines an offset surface 66'. The offset surface 66' is defined adjacent to the outer edge of a rib 75 which extends radially beyond the bearing surface 62'. The rib 75 extending radially beyond the bearing surface 62' abuts the end 33 of the bearing 20 to hold the stem 51' within the bearing 20 against outward movement, thereby obviating the abutment wall 67 which is included in the stem 51. Therefore, it should be understood that the inner end of a stem for the invention could be any of a number of shapes which would define an offset surface and be adequately strong.

The invention provides a perpendicular type toilet trip lever assembly which is easy and inexpensive to manufacture, assemble, and mount. The entire assembly can be provided with only four separate parts. Each part is suitable to be easily molded from inexpensive materials. No subassembly operations are required before the assembly is mounted to the toilet tank. Moreover, the components of the assembly interconnect with one another so that no mechanical fasteners or tools are required to assemble and mount the assembly to the toilet tank.

Numerous modifications and variations to the preferred embodiment, in addition to those mentioned above, will be apparent to those skilled in the art. For example, the pivot post 44 need not be integral with the retaining means 21 but could be a part of the boom with a bore to receive the pivot post defined in the retaining means 21. In addition, the positions of the connector pins 32 and the bayonet slots 40 could be reversed, with the slots in the bearing 20 and the pins on the retaining means 21. Therefore, it is not intended that the invention be limited by the scope of the preferred embodiment or the description thereof.

I claim:

1. A toilet trip lever assembly mountable in a hole in a side wall of a toilet tank, comprising:

a bearing extendable through the hole and having an axial bore therethrough;

retaining means removably connectable to the bearing inside the toilet tank for limiting outward movement of the bearing relative to the hole;

a pivot post extendable radially from the retaining means;

a stem positionable within the bearing for rotational movement therein, the inner end of the stem extendable into the tank and including an offset surface;

a handle connectable to the outer end of the stem which is operable by a user to rotate the stem;

a boom pivotally and directly mounted on the retaining means by the pivot post so as to permit pivoting motion of the boom about the pivot post axis in a plane substantially perpendicular to the tank side wall through which the bearing is extendable; and an arm affixed to the boom extendable from said boom to said stem offset surface;

whereby rotation of the stem and offset surface can pivot the boom.

2. A toilet trip lever assembly as in claim 1, wherein: the pivot post forms an integral part of the retaining means and the boom pivots on the pivot post.

3. A toilet trip lever assembly as in claim 1, wherein the retaining means includes a nut, the nut can be affixed to the bearing by a bayonet-type connection, and said nut has a resilient outer portion which can bear against the tank inner wall to hold the nut and bearing in a fixed rotational position with respect to each other.

4. A toilet trip lever assembly as in claim 1, wherein the portion of the stem adjacent to the inner end of the stem has an upwardly open recess, the stem has an abutment wall inward of the recess, and the arm is positionable in the recess so that the arm can abut against the abutment wall to limit outward movement of the stem while permitting movement of the boom in a plane perpendicular to the tank side wall through which the bearing is extendable.

5. A toilet trip lever assembly mountable on a side wall of a toilet tank through a tank wall opening in that wall, comprising:

a bearing mountable in the opening;

means for limiting the bearing's movement relative to the tank wall opening;

a handle stem journaled for rotation in the bearing and extendable inwardly into the tank, said stem having adjacent its inward end a recess and an abutment wall inward of the recess;

a boom mountable on the assembly in the tank for pivoting movement in a plane substantially perpendicular to the side wall that has said opening in response to rotation of the stem; and said boom having an arm positionable inside said stem recess so as to limit outward movement of the stem while permitting movement of said boom in said plane.

6. A toilet trip lever assembly as in claim 5, wherein said recess opens upwardly.

7. A toilet trip lever assembly mountable on a side wall of a toilet tank through a tank wall opening, of the type having a bearing mounted in the opening, a handle stem journaled for rotation in the bearing and extendable into the tank, and a nut within the tank to limit outward movement of the bearing relative to the hole, the improvement wherein:

the nut can be affixed to the bearing by a bayonet-type connection; and the nut has a resilient outer portion which can bear against the tank inner wall to hold the nut and bearing in a fixed rotational position with respect to each other.

8. A toilet trip lever assembly as in claim 7, wherein the bayonet-type connection comprises at least one connector pin on said bearing and at least one corresponding slot in said nut.

9. A toilet trip lever assembly as in claim 8, wherein each slot in said nut includes a mouth channel which opens to receive the corresponding connector pin, a seat spaced a distance in a first angular direction from the mouth channel, and a connecting track to provide a passage from the mouth channel to the seat so that the nut can be slid onto the bearing with the resilient outer portion bearing against the side wall and each mouth channel aligned with the corresponding connector pin until the connector pin is aligned with the connecting track, then turned in a direction opposite to the first direction until each connector pin is aligned with the seat, and then released so that each connector pin enters its corresponding seat and sits therein.

* * * * *